US005378499A

United States Patent [19]

Martin et al.

[11] Patent Number: 5,378,499

[45] Date of Patent: Jan. 3, 1995

[54] METHOD OF APPLYING ABRASIVES TO BULLETS FOR USE IN PRESSURE (FIRE) LAPPING OF GUN BARRELS

[75] Inventors: Merrill D. Martin, Oakland; Roger B. Johnston, Lafayette; Howard E. Harrison, San Francisco, all of Calif.

[73] Assignee: Neco/Nostalgia Enterprises Co., Emeryville, Calif.

[21] Appl. No.: 989,234

[22] Filed: Dec. 11, 1992

[51] Int. Cl.[6] ..... B05D 3/12

[52] U.S. Cl. ..... 427/242; 427/203; 427/204; 427/205; 427/416; 427/419.7; 427/419.8

[58] Field of Search ..... 427/242, 11, 203, 204, 427/239, 214, 216, 416, 419.7, 419.8; 42/95

[56] References Cited

U.S. PATENT DOCUMENTS

| | | | |
|---|---|---|---|
| 1,231,227 | 6/1917 | Williams . | |
| 1,495,008 | 5/1924 | Feagin . | |
| 2,765,740 | 10/1956 | Norman | 102/39 |
| 2,999,767 | 9/1961 | Clay et al. | 427/242 |
| 3,476,047 | 11/1969 | Davis | 102/39 |
| 3,740,883 | 6/1973 | Kyle | 42/1 R |
| 3,876,450 | 4/1975 | Tanner | 427/242 |
| 4,169,906 | 10/1979 | Hallstrom et al. | 427/204 |
| 4,196,670 | 4/1980 | Vatsvog | 427/335 |
| 4,315,780 | 2/1982 | Rupp et al. | 42/95 |
| 4,328,632 | 5/1982 | Beers | 42/1 BC |
| 4,378,256 | 3/1983 | Watson-Adams | 427/11 |

(List continued on next page.)

FOREIGN PATENT DOCUMENTS

| | | | |
|---|---|---|---|
| 698525 | 11/1964 | Canada | 427/216 |
| 721060 | 11/1965 | Canada . | |

OTHER PUBLICATIONS

*Precision Shooting*, vol. 33, No. 2 (Jun. 1987) pp. 30–32 (Merrill Martin).

*Primary Examiner*—Shrive Beck
*Assistant Examiner*—Diana Dudash
*Attorney, Agent, or Firm*—Malcolm B. Wittenberg; James R. Cypher

[57] ABSTRACT

A method for lapping of gun barrels on fully assembled firearms is provided using cartridges fitted with lapping bullets impregnated with abrasive. The present invention provides a process for simultaneously impregnating a quantity of lapping bullets with an abrasive, in which a quantity of unlubricated bullets are placed in a tumbler with steel balls and quantity of the desired abrasive. The speed of rotation of the tumbler, and the shape of the tumbler are selected so that the bullet/abrasive/-tumbling media mix folds on itself, thus providing an even impregnation of abrasive on the bullets and minimizing any deformation of the bullets. The mixture is allowed to tumble for a period of time, typically about an hour, after which a sufficient quantity of the abrasive is firmly embedded on the surface of each bullet. The abrasive impregnated bullets can then be coated with a protective and lubricating finish, such as carnauba wax, if desired. The abrasive-impregnated bullets can then be sized and lubricated and loaded into a cartridge containing gun powder and a wad positioned against the base of each bullet. Using this procedure, it is possible to manufacture in quantity a series of lapping cartridges having coarse, medium, fine and polishing grits impregnated on the bullets. Pressure (Fire) Lapping can then be carried out in stages using the loaded cartridges by firing through the barrel a series of lapping bullets impregnated with coarse abrasive, followed in order by the lapping bullets with the medium, fine and polishiing grits. The barrel is cleaned and checked after every ten rounds or so, or when changing from one type grit to another. This process removes dimensional variations and roughness in the bore, and produces a gun barrel which is more accurate, and less susceptible to copper, carbon and lead fouling.

10 Claims, 1 Drawing Sheet

U.S. PATENT DOCUMENTS

| | | | |
|---|---|---|---|
| 4,454,175 | 6/1984 | Martin et al. | 427/242 |
| 4,753,094 | 6/1988 | Spears | 427/11 |
| 4,783,925 | 11/1988 | Pollock, Jr. | 42/90 |
| 4,843,750 | 7/1989 | Blase | 42/95 |
| 4,858,534 | 8/1989 | Wallace | 427/239 |
| 4,998,368 | 3/1991 | Blase | 42/95 |

OTHER PUBLICATIONS

*Precision Shooting,* vol. 33, No. 5 (Sep. 1987) p. 20 (Merrill Martin).

*Precision Shooting,* vol. 34, No. 3 (Jul. 1988) p. 50 (Merrill Martin).

*Precision Shooting,* vol. 34, No. 4 (Aug. 1988) pp. 10–13 (Merrill Martin).

*Precision Shooting,* vol. 34, No. 9 (Jan. 1989) pp. 47–48 (Merrill Martin).

*Precision Shooting,* vol. 34, No. 11 (Mar. 1989) p. 31 (Steve Wurzburger).

*Precision Shooting,* vol. 35, No. 1 (May 1989) pp. 22–23 (Merrill Martin).

*Precision Shooting,* vol. 35, No. 5 (Sep. 1989) pp. 6–7 (Merrill Martin).

*Precision Shooting,* vol. 35, No. 7 (Nov. 1989) pp. 46–47 (Merrill Martin).

*Precision Shooting,* vol. 35, No. 8 (Dec. 1989) pp. 14–15 (Merrill Martin).

*Precision Shooting,* vol. 36, No. 1 (May 1990) pp. 42–43 (Merrill Martin).

*Precision Shooting,* vol. 36, No. 4 (Aug. 1990) pp. 44–46 (Merrill Martin et al.).

*Precision Shooting,* vol. 36, No. 7 (Nov. 1990) pp. 10–13 and 29 (Merrill Martin et al.).

*Precision Shooting,* vol. 36, No. 12 (Apr. 1991) pp. 36–37 (Merrill Martin).

*Precision Shooting,* vol. 37, No. 1 (May 1991) pp. 30–32 (Merrill Martin).

*Precision Shooting,* vol. 37, No. 4 (Aug. 1991) pp. 58–59 (Merrill Martin).

*Precision Shooting,* vol. 32, No. 7 (Nov. 1986) pp. 25–27 (Merrill Martin).

*Precision Shooting,* vol. 32, No. 12 (Apr. 1987) pp. 16–20 (Merrill Martin).

METHOD OF APPLYING ABRASIVES TO BULLETS FOR USE IN PRESSURE (FIRE) LAPPING OF GUN BARRELS

BACKGROUND OF THE INVENTION

The present invention relates to the use of abrasives for lapping gun barrels, and in particular relates to a process for embedding abrasives in the surface of bullets for lapping of gun barrels.

All shooters, whether they are police officers, olympic shooters, or weekend enthusiasts, have one common goal: hitting their target accurately and consistently. Accuracy and consistency in shooting depend largely on the skill of the shooter and the construction of the firearm and ammunition.

The accuracy of a firearm can be enhanced by careful attention to the component parts of the firearm. Thus, accuracy can be enhanced by improving the bedding of the barrel and action; securely mounting sight and scope bases; trigger adjustment; checking for eccentricities of and indexing cartridge casings; case neck turning and tension of bullet release; use of match grade bullets; careful cartridge preparation; and providing a barrel capable of providing a smooth, even passage for a bullet.

It is well known that gun barrels are manufactured with tolerances which may vary depending on the use of the firearm. Factory/military gun barrels typically include manufacturing machine marks in the bore, poor surface finish, small burrs and sharp edges from the rifling process, non-uniform rifling twist rate, or uneven bore diameters. Factory type barrels can, as a result of the manufacturing process, be tapered, with the breech end smaller than the muzzle end or vice versa. Further, it is not unusual for gun barrels to have "tight" spots at varying locations along the length of the bore. These "tight" spots and taper variations represent dimensional deviations of the bore which can be within tolerances for the barrel, yet still adversely affect accuracy since they influence the travel of the bullet in the barrel and provide a locus for the deposit and build up of metal from the bullets fired (referred to in the art as "metal fouling"). The greater the deviation and fouling, the greater the loss of accuracy. Such loss of accuracy can produce wide variations in bullet trajectory, which in target shooting produces a large pattern or spread of bullet holes on the target (and a lower score than would be expected if the spread of bullet holes were small, producing a "tight" group). These variations in the dimensions, finish, and twist of the bore should therefore be considered, and corrected, if possible, in order to obtain optimum accuracy.

Conventional lapping has been used as a finishing process for custom barrels to remove some or all of the machining marks, burrs, sharp edges, and dimensional deviations in the bore. Conventional lapping consists of placing an abrasive/lapping compound on a bore-cast lead slug mounted on a rod and repeatedly passing the slug through the bore of the newly cut barrel to remove the unwanted metal and polish what is left. The process takes place in steps, beginning with a coarse abrasive and lapping compound, and proceeding through abrasives of increasingly finer grit. However, this method is disadvantageous because it does not duplicate the environment of pressure and bearing surface which takes place during the passage of a bullet through the barrel. Further, conventional hand lapping, while capable of producing excellent results, tends to be a very time consuming and expensive process.

The problems of conventional lapping have been solved to a certain extent by a process known as "pressure (fire) lapping." In pressure (fire) lapping, the bore of a fully assembled gun is cleaned and all deposits of copper or lead are removed, using cleaning compounds intended for that purpose. The barrel is then checked to determine the location of tight or rough spots by pushing a lubricated soft slug through the bore from end to end. A series cf abrasives are used, as in conventional lapping, however in pressure (fire) lapping bullets are impregnated with the desired abrasive by rolling individuai lubricated bullets with a desired abrasive between two steel plates under pressure. After embedding abrasive in each series of lap bullets, the abrasive must be cleaned off of the plates before beginning to embed the next series of lap bullets.

Excess abrasive is wiped off the impregnated bullets, which are then loaded into cartridges with a minimal powder charge and a plastic wad positioned against the base of the abrasive-impregnated bullet. The cartridges with the abrasive-impregnated bullets are fired through the barrel on a series, with the coarse abrasive impregnated bullets being fired first, followed may a series of each of the finer grits. In between each type of abrasive or every ten rounds or so, the gun is cleaned and checked to determine the extent to which the dimensional irregularities are being removed. Anywhere from about 10 to about 40 bullets impregnated with each abrasive may be required to substantially reduce or completely remove the observed tight spots.

Unlike conventional lapping, pressure (fire) lapping duplicates the environment which exists in the bore during the firing of a bullet. Conventional lapping does not apply torque to the bearing surfaces; however, because the identical conditions of heat and pressure are recreated and because torque is applied by the lapping bullet which bears against the rifling during pressure (fire) lapping, the irregularities in the rate of twist of the rifling, which are typically found at the muzzle and breech, will approach uniformity and bearing edge of the rifling land is smoothed. Additionally, in pressure (fire) lapping abrasive marks are properly aligned with the direction of bullet travel, and reamer and tool marks in the bore are reduced and smoothed. Many of those who have used pressure (fire) lapping report noticeable to significant improvements in accuracy. However, pressure (fire)lapping is also a tedious process, and typically takes approximately 8 hours per gun barrel. In particular the method of impregnating bullets by individually rolling in abrasive and lapping compound between two plates under pressure is particularly tedious and time consuming, especially when one considers that 100 bullets, or more, may need to be impregnated. Furthermore, the curvature of some rifle bullets will require a 2-step process, whereby the base section and the nose section are impregnated with abrasive separately.

Accordingly, the need exists for an improvement to the pressure (fire) lapping process which will reduce the time required to fire lap a gun barrel. In particular, a need exists for an easier and more efficient method of impregnating bullets with abrasive for use in pressure (fire) lapping.

SUMMARY OF THE INVENTION

In one embodiment, the present invention provides an improved method for pressure (fire) lapping of gun barrels. In another embodiment, the present invention provides a process for impact plating or impregnating batches of bullets with an abrasive; thus enabling the economical manufacture of pressure (fire) lapping cartridges with pre-impregnated bullets, which can then be used by a gun owner to fire lap a gun barrel at a significant savings of time.

In the process of the present invention, a quantity of unlubricated bullets are placed in a tumbler with steel balls as a tumbling media and a quantity of the desired abrasive. The speed of rotation of the tumbler, and the shape of the tumbler should be selected so that the bullet/abrasive/tumbling media mix "cascades," thus providing an even impregnation of abrasive in the surface of the bullets and minimizing or avoiding any deformation of the bullets. The bullets can be left to tumble for a period of time, typically anywhere from about an hour to about five hours, after which a sufficient impregnation of abrasive is obtained. A second tumbling of the abrasive-impregnated lapping bullets is preferred, to coat the lapping bullets with a dry lubricating coating such as carnauba wax or molybdenum disulfide. This can be done by placing the abrasive-impregnated bullets into a similar rotary tumbler, with hardened, polished steel balls and the dry lubricant, again selecting a speed of rotation to insure that the bullets/carnauba wax/tumbling media cascades as rotation occurs. The abrasive-impregnated bullets can then be sized and lubricated if necessary, and loaded into a cartridge containing a low velocity powder load for the particular caliber and type of bullet, with a wad positioned against the base of each bullet if desired. Pressure (Fire) Lapping can then be carried cut using the loaded cartridges

BRIEF DESCRIPTION OF THE DRAWINGS

A better understanding of the invention and its advantages will be apparent from the detailed description taken in conjunction with the accompanying, drawings in which.

DETAILED DESCRIPTION OF THE BEST MODE OF THE INVENTION

Figure 1:
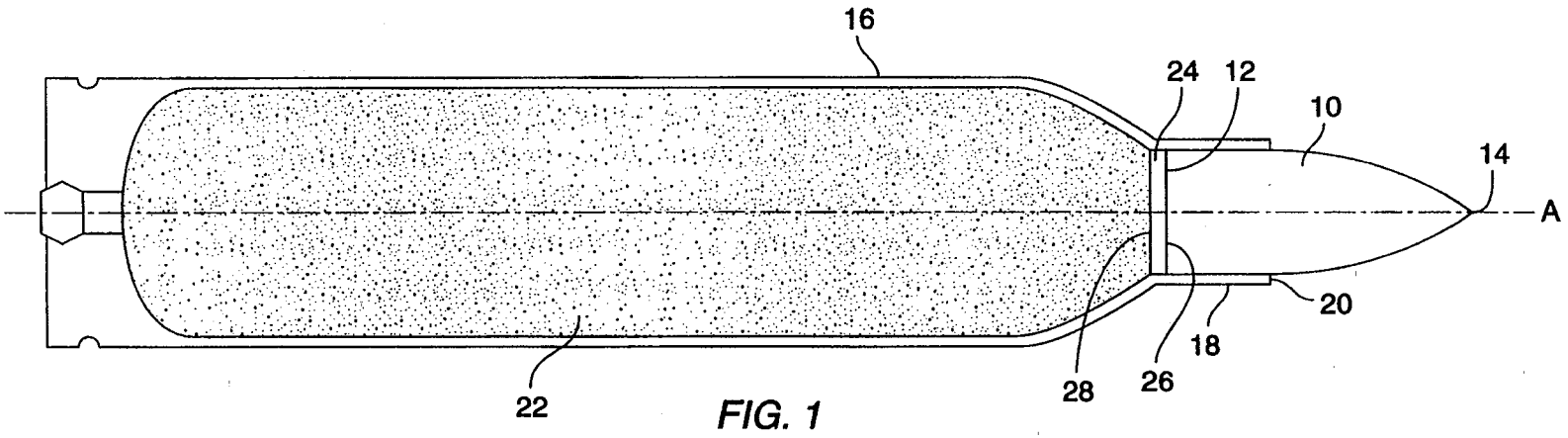
FIG. 1 is an illustrative cut away view showing an assembled cartridge produced in accordance with the present invention.

The present invention uses a method for impregnating bullets with abrasives by tumbling in a medium of steel balls and abrasives. A method for the mechanical plating of molybdenum disulfide by tumbling with steel balls was set forth in U.S. Pat. No. 4,454,175, which is incorporated herein by reference. Molybdenum disulfide is, however, a lubricant, which is a fundamentally different material from the abrasives used in pressure (fire) lapping. Furthermore, the '175 patent teaches the use of a fibrous material mixed with the molybdenum disulfide to prevent clumping, and a smaller size shot than that which is preferable for a process of the present invention.

A tumbling mixture of the present invention comprises a predetermined amount of steel balls; a predetermined amount of lap bullets; and, a predetermined amount of abrasive. The preferred size of the steel balls is from about 0.125 inches to about 0.250 inches in diameter, depending on the size of the bullets to be impregnated, with hardened steel balls being most preferred.

The lap bullets can be jacketed or clad (i.e., have a layer of copper or some other metal over the outside of the bullet core material), or produced from a single homogeneous metal or metal alloy, such as lead, lead alloy, or bronze. If cast lead bullets are used, they can range from relatively soft to relatively hard, and preferably have a Brinnell Hardness Number ("BHN") ranging from about 12 BHN to about 20 BHN. Lead bullets should be uncoated and unlubricated before impregnating with abrasive. The lap bullets should be sized before impregnating with abrasive.

The abrasive can be selected from a variety of grinding and lapping compounds, including diamond powders, cubic boron nitride, norbide abrasives, silicon carbide, aluminum oxide, fused alumina, corundum, garnet, and unfused alumina, ranging in size from a relatively coarse grit to an extremely fine grit. The preferred abrasives, and number of stages, for performing the pressure (fire) lapping process are:

| | | |
|---|---|---|
| Stage 1 | Coarse - 220 Grit (~173 μ) | Silicon Carbide |
| Stage 2 | Medium - 400 Grit (~23 μ) | Silicon Carbide |
| Stage 3 | Fine - 800 Grit (~7 μ) | Silicon Carbide |
| Stage 4 | Extra Fine - 1200 Grit (~3 μ) | Aluminum Oxide. |

Additionally, we have found laboratory grade abrasives, in which at least 90% of the abrasive particles are the indicated size, produces satisfactory results. Other stages may be added, with intermediate grits to those shown, or other grits may be substituted for those shown, however, we prefer the four stages shown above because we have found they produce excellent results.

To reduce or eliminate deformation of the lapping bullets, it is preferred to select a tumbling drum which has a shape and speed which will cascade the tumbling medium. By "cascade" we mean the drum has a shape and operates at a sufficiently slow speed so that the tumbling mixture is rotated tc form a slope that can very from very gentle to very steep, and the top portion of the mixture continuously slumps or rolls downhill. We have found the design of the 10 pound capacity Viking Rotary Tumbler (manufactured by American Gem Co,) which includes a hexagonal tumbling drum which rotates at a speed of about 20 RPM. The processing time (the period the tumbler is permitted to operate with the mixture) can vary from somewhat less than one hour to three hours or longer, depending on the quantity of abrasive used. The following examples are presented as an illustration of the process, and should not be considered a limitation:

Example 1

Lapping bullets for Stage 1 were prepared by placing into a Viking Rotary Tumbler: 7 pounds of 0.125 inch steel shot, 3 pounds of 0.30 caliber lead bullets, the bullets weighing 180 grains each and having a hardness of about 14 BHN; and 25 grains [about 0.057 ounce or 1.62 grams] of 220 Grit silicon carbide. The tumbler was rotated at 20 RPM for a period of one hour. The tumbling mixture was removed from the drum, and the abrasive-impregnated lapping bullets were separated and set aside. Lapping bullets for Stage 2 were prepared using an identical procedure, but with 25 grains of 400 Grit abrasive. Stage 3 lapping bullets were prepared using an identical procedure, but using 25 grains of 800 Grit abrasive. Stage 4 lapping bullets were prepared using an identical procedure, but with 25 grains of 1200 Grit Aluminum Oxide abrasive.

Example 2

Lapping bullets for Stage 1 were prepared by placing into a Viking Rotary Tumbler: 7 pounds of 0.0125 inch diameter hardened steel balls, 3 pounds of 0.30 caliber copper jacketed bullets, the bullets weighing 150 grains each; and 25 grains [about 0.057 ounce or 1.62 grams] of 220 Grit silicon carbide. The tumbler was rotated at 20 RPM for a period of five hours. The tumbling mixture was removed from the drum, and the abrasive-impregnated lapping bullets were separated and set aside. Lapping bullets for Stage 2 were prepared using an identical procedure, but with 25 grains of 400 Grit abrasive. Stage 3 lapping bullets were prepared using an identical procedure, but using 25 grains of 800 Grit abrasive. Stage 4 lapping bullets were prepared using an identical procedure, but with 25 grains of 1200 Grit Aluminum Oxide abrasive.

One tumbler can be used to produce abrasive-impregnated lapping bullets for all four stages. However, this requires removal of the tumbling media and cleaning of the drum between stages to prevent contamination of the subsequent finer grits with the grits previously used. More preferred is to use a dedicated rotary tumbler for each different kind of abrasive (or coating) to be embedded or applied. This is very advantageous in a commercial setting because it allows the simultaneous production of lapping bullets for all four stages, and reduces the frequency of cleaning required for each rotary tumbler.

Following tumbling, the abrasive-impregnated bullets are removed from the tumbler. The abrasive is firmly embedded, substantially evenly across the entire surface of the lap bullets. Further, there is little, if any, loose abrasive to brush away. In the event one does find loose abrasive clinging to the lapping bullets, the abrasive-impregnated lapping bullets can be placed into a rotary tumbler with a medium corn cob grit, or some other similar fibrous medium, and tumbled for about 10 minutes to remove the loose abrasive from the surface of the lapping bullets.

The abrasive coated lapping bullets are then preferably coated with a dry lubricant, such as carnauba wax or molybdenum disulfide. This can be done by tumbling the abrasive coated bullets in a rotary tumbler as described above with a predetermined amount of steel burnishing media, such as 0.125 inch diameter hardened, polished carbon steel balls, and a quantity of granulated or powdered dry lubricant. For example, 7 pounds of hardened steel balls with 15 grains of powdered dry lubricant and 3 pounds of abrasive impregnated lapping bullets will coat the bullets with a fine, thin layer of dry lubricant. The time for this tumbling operation can vary from a few minutes to an hour or longer. For example, ten minutes has been found to produce a fine, thin coating of carnauba, while an hour or longer may be required to obtain a satisfactory coating of other lubricants, such as molybdenum disulfide.

The abrasive impregnated cast lead lapping bullets are sized and lubricated with a suitable lubricant, such as TAURAK® (a registered trademark of Texaco Corp.), a high temperature, water soluble lubricant. and are then ready for loading into cartridge casings to produce rounds or cartridges for pressure (fire) lapping. Jacketed lapping bullets do not require sizing or lubrication before loading. As shown in FIG. 1, each abrasive-impregnated lapping bullet has a base 12 and a nose 14.

Clean cartridge cases 16 should be selected for loading and each should have a neck 18 and a mouth 20 dimensioned to receive the base 12 of an abrasive coated lap bullet 10 without shaving the bullet. A low velocity reduced powder load 22 is placed in each cartridge case 16. The specific load is determined by the particular caliber and characteristics of the lapping bullet 10. For lead bullets, recommendations for specific loads can be found. for example, in the Lyman *Cast Bullet Handbook*, Third Edition; for jacketed bullets, recommendations for loads which can be used in pressure (fire) lapping can be found in the reduced load section of the Speer *Manual No.* 10.

A wad 24 can then be inserted into the mouth 20 of the cartridge case 16. Wads are preferred for use with cast lead lapping bullets, and may be desirable with jacketed lapping bullets. Wad 24 is typically a disc of a size to fit snugly inside the neck 18, and has a first side 26 which faces the base 12 of bullet 10 and a second side 28 which faces the powder 22. The wad 24 is preferably seated square and flush with, or slightly below, the case mouth 20 in preparation for receiving the lapping bullet 10 so that the first side 26 of wad 24 is seated against the base 12 and substantially perpendicular to the longitudinal axis A of the loaded cartridge. If desired, to insure the wad seats firmly against the base 12 of bullet 10 and remain at the base of the bullet 10 when it is fired, a drop of glue can be placed on the first side 26 just before the bullet is seated. For this purpose, an instant or fast curing type adhesive, such as cyanoacrylate or other "super glue", is preferred.

A wad 24 is preferred for pressure (fire) lapping because it produces a gas seal that prevents the impregnated abrasive from being blown off the lapping bullet 10 and down the barrel ahead of the bullet. Wads can be made from almost any substance capable of producing a gas seal in a firearm, such as neoprene rubber, low-density polyethylene, polyurethane, polyvinylchloride, or lube saturated hard felt. Plastic wads are preferred, and low-density polyethylene, polyurethane and polyvinylchloride are most preferred.

Wads are typically cut with a die to provide substantially square sides on the wad. However, a slight flaring or taper is produced with plastic wads between the top side of the wad, which is the side of the plastic sheet which the die enters, and the bottom of the wad, which is the side of the plastic sheet from which the die emerges, producing a wad with a bottom side which is slightly larger than the top side. Although the difference between the two sides is difficult or impossible to see with the naked eye, we have found it is most preferable to place the larger, bottom side towards the powder and the smaller, top side towards the bullet base 12 to provide a maximum gas seal. Thus, for wads in which such differences occur, and in particular for die cut plastic wads, the bottom side should be identified as second side 28 and the top side should be identified as the first side 26. With opaque plastics, either side of the wad 24 can be easily identified by marking or coating one side of the sheet from which the wads are cut. For example, if the bottom side is marked, the wads produced from the sheet should be loaded into cartridge cases 16 with the marked/second side 28 down. If the top side is marked, the wads produced from the sheet should be loaded into cartridge cases with the mar- Ked/first side 26 up. With transparent plastics, such as PVC, simply marking one side will not provide a sufficient visual indication of which side has been marked, since both sides will visually appear to be marked. Thus, when dealing with transparent plastic wads, it is preferable to coat the side of the plastic sheet they are cut from with two layers of contrasting colors. For example, a layer of red paint can be sprayed on the bottom side of a PVC sheet and dried. This is followed by covering the layer of red with a contrasting color, such as a layer of black paint sprayed over the red. Thus, when the wads are cut, a black side marks the bottom/-second side 28, and a red side marks the top/first side 26, making the loading of such wads simple: if one looking into the open mouth of the case sees black, the wad is improperly loaded (since the black side should be loaded facing the powder); if one sees red, the wad is properly loaded.

The base 12 of the abrasive impregnated lapping bullets 10 can then be inserted into mouth 20 and seated in neck 18 of case 16 with a normal bullet seating die. The lapping bullet 10 can be set to any length desired. However, the position of the lapping bullet 10 in abrasive lapping cartridges which are mass-produced will preferably be determined by reference to the standards recommended by the Standard American Arms Manufacturers Institute (SAAMI). The lapping bullets 10 or loaded cartridges are also preferably marked to identify the kind of abrasive impregnated on the lapping bullets 10 so that the user does not confuse cartridges for any one stage with cartridges for any of the other three stages.

With the pre-assembled cartridges, pressure (fire) lapping is quickly and easily carried out on a fully assembled gun. The gun should be thoroughly cleaned and all metallic deposits removed from the bore of the barrel before pressure (fire)lapping. The cleaning sequence is preferably always begun by inserting a cleaning rod through the barrel from the breech, attaching a patch to the end of the cleaning rod extending from the muzzle, oiling the patch, and then pulling the patch through the bore from the muzzle to the breech. Pulling a patch through the bore towards the breech tensions the rod and keeps the rod centered and clear of the rifling. Pushing hard into a dry bore with a tight patched cleaning rod buckles the rod into the rifling and wears the bore. Once a wet patch is pulled through to the breech, the bore is lubricated and the rod can then be pushed back toward the muzzle with ease. This can be followed by appropriate cleaning compounds, such as Remington Bore Cleaner or J-B Bore Paste. It is most preferred that cleaning be conducted so that only cloth patches contact the barrel. However, if the barrel is badly leaded (not copper fouled) it can be cleaned by winding a fine steel wool around an undersized brass brush mounted on the end of a cleaning rod, adding a few drops of a suitable lubricant, such as Rem TM Oil, a teflon-based lubricant, and passing the cleaning rod through the barrel. Excessive copper fouling may require two or more applications of an appropriate cleaner such as Remington Bore Cleaner or J-B Bore Paste. Ammonia based cleaners should be avoided.

Once the bore is clean, a soft slugging bullet should be passed through the barrel from end to end to identify rough and tight spots. The slugging bullet is preferably pure lead, with a hardness of 3–5 BHN. The bore is first lubricated, preferably with a high viscosity grease, such as, for example, STP® Oil Treatment. The slugging bullet is also greased, and the pointed end is inserted into the muzzle end while pushing on the base of the bullet with the cleaning rod. If necessary, the end of the cleaning rod can be gently tapped to get the bullet started. The slugging bullet is pushed slowly back and forth through the bore, feeling for a uniform resistance or drag from breech to muzzle and back again. Most preferably, two cleaning rods are used: one from the muzzle and one from the breech, so that the soft slugging bullet can be gently bumped between the rods to increase the drag and fit. It is not unusual for the slug to get very loose or tight at one end of the bore or the other. Typically, in new or relatively new factory-type barrels the muzzle end is the loose end. At the loose end, the slug should be bumped up to increase its size to match the bore before it is carefully pushed out for measurement. At the tight end, the slug will be compressed by the bore to match the size and shape of the bore before it is carefully pushed out for measurement. By following this process, the size of the breech end and the muzzle end can be determined and the location of intermediate tight spots can be ascertained. This information can be important in determining how many, and which stages, of abrasive impregnated lapping bullets to use in pressure (fire) lapping.

If the bore is of uniform diameter, with only rough spots or machining marks, little metal will need to be removed. Accordingly, only a few rounds of the First Stage (coarse grit) cartridges will be required. However, more rounds of the First Stage cartridges will be required as the variation in dimensions in the bore of the barrel increase, since more metal will need to be removed to approach dimensional uniformity in the bore. In a typical tapered barrel, the firelapping process can begin by loading and firing ten First Stage cartridges. Each series of ten First Stage cartridges removes less than about 0.0001 inches of metal from the bore. The bore should then be cleaned and re-slugged to determine if the tight spots have been removed. If not, a further series of ten First Stage cartridges can be loaded and fired, again followed by cleaning and slugging to check progress. For some barrels, up to about forty First Stage cartridges may be required to remove the rough and tight spots and make the barrel more uniform. For other barrels, even more may be required. Because each barrel has unique characteristics, it is highly preferred that the pressure (fire) lapping proceed in ten shot increments, followed by thoroughly cleaning and checking/measuring the bore before continuing.

Once the bore has been cleared and smoothed by metal removal using First Stage cartridges, pressure (fire) lapping proceeds to the Second Stage. Again, the preferred method is to load and fire a series of ten Second Stage (medium grit) cartridges, followed by cleaning and checking. The second stage removes very little metal, and primarily polishes the bore marks created during the First Stage. It is preferred that at least one series of Second Stage cartridges be fired, and it may be desirable to load and fire several series of Second Stage cartridges.

Following the use of the Second Stage cartridges, the bore is thoroughly cleaned and measured/checked, and pressure (fire) lapping proceeds to the third stage. Once again, the preferred method is to load and fire a series of ten Third Stage (fine grit) cartridges, followed by cleaning and checking the bore. The Third Stage is used to polish marks created during the Second Stage. It is preferred that at least one series of ten Third Stage cartridges is loaded and fired, and it may be desirable to Icad and fire several series.

Following the use of the Third Stage cartridges, the bore is thoroughly cleaned and measured/checked (with the lead slug) and pressure (fire) lapping proceeds to the fourth stage. Once again, the preferred method is to load and fire a series of ten Fourth Stage (extra fine or polishing grit) cartridges, followed by cleaning and checking the bore. The Fourth Stage provides a final polish to the bore, removing marks remaining after the Third Stage, and appears to contribute substantially to the reduction in copper fouling and frequency of cleaning which is a benefit of pressure (fire) lapping. It is preferred that at least one series of ten Fourth Stage cartridges is loaded and fired, and it may be desirable to load and fire several series.

One way to check the progress made during pressure (fire) lapping is to shoot the abrasive-impregnated bullets at a target. Typically, one will observe a reduction in the size or spread of the group as pressure (fire) lapping proceeds and the variations in the bore dimensions are reduced. Once pressure (fire) lapping is complete, the bore should be cleaned thoroughly to remove any residual abrasive, and lubricated with a light machine oil. Besides a marked improvement in accuracy, Pressure (Fire) Lapping has been found to reduce carbon, lead and copper fouling.

While the preferred embodiments have been described in detail, and shown in the accompanying drawings, one skilled in the art will recognize that various further modifications are possible without departing from the scope of the invention as set forth in the appended claims.

We claim:

1. A method of coating bullets capable of pressure fire lapping gun barrels by forming substantially uniform coatings of abrasives on surfaces of said bullets, said method comprising introducing said bullets to a drum capable of rotating and causing said bullets to cascade therein, providing to said drum tumbling media and abrasives followed by rotating said drum to cause said bullets, tumbling media and abrasives to cascade within said drum for a sufficient period of time to create said uniform coating of said abrasives on said surfaces of said bullets wherein said abrasives comprise a member selected from the group consisting of diamond powder, cubic boron nitride, boron carbide, silicon carbide, aluminum oxide, corundum and garnet.

2. The method of claim 1 wherein said rotation of said drum is continued for a period of between one to five hours.

3. The method of claim 1 wherein subsequent to the creating of said uniform coating of said abrasive, said bullets are coated with a dry lubricant.

4. The method of claim 3 wherein said dry lubricant is applied by introducing said bullets to said drum and causing said bullets to cascade therein, providing to said drum tumbling media and dry lubricant followed by rotating said drum to cause said bullets, tumbling media and dry lubricant to cascade within said drum to create a uniform coating of said lubricant on the surfaces of said bullets.

5. The method of claim 4 wherein said lubricant comprises a member selected from the group consisting of carnauba wax and molybdenum disulfide.

6. The method of claim 1 wherein said tumbling media comprises steel balls sized from approximately 0.125 to 0.250 inches in diameter.

7. The method of claim 1 wherein said abrasive is sized as 220 grit.

8. The method of claim 1 wherein said abrasive is sized as 400 grit.

9. The method of claim 1 wherein said abrasive is sized as 800 grit.

10. The method of claim 1 wherein said abrasive is sized as 1200 grit.

* * * * *